US012577897B2

(12) United States Patent
Blumenschein

(10) Patent No.: US 12,577,897 B2
(45) Date of Patent: Mar. 17, 2026

(54) METHOD AND CONTROL DEVICE FOR OPERATING A DIESEL MOTOR VEHICLE FOR EMISSION REDUCTION, AND MOTOR VEHICLE

(71) Applicant: Bayerische Motoren Werke Aktiengesellschaft, Munich (DE)

(72) Inventor: Josef Blumenschein, Aschach an der Steyr (AT)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 18/708,630

(22) PCT Filed: Dec. 12, 2022

(86) PCT No.: PCT/EP2022/085382
§ 371 (c)(1),
(2) Date: May 9, 2024

(87) PCT Pub. No.: WO2023/134936
PCT Pub. Date: Jul. 20, 2023

(65) Prior Publication Data

US 2025/0003360 A1 Jan. 2, 2025

(30) Foreign Application Priority Data

Jan. 13, 2022 (DE) ..... 10 2022 100 696.4

(51) Int. Cl.
*F01N 3/20* (2006.01)
*F01N 9/00* (2006.01)

(52) U.S. Cl.
CPC ..... *F01N 3/2013* (2013.01); *F01N 9/005* (2013.01)

(58) Field of Classification Search
CPC ..... F01N 2240/16; F01N 2900/0602; F01N 2900/1602; F01N 3/103; F01N 3/2013; F01N 3/2066; F01N 9/005
See application file for complete search history.

(56) References Cited

U.S. PATENT DOCUMENTS

2011/0258984 A1 10/2011 Santoso et al.
2016/0251989 A1* 9/2016 Upadhyay ..... F01N 3/208 60/274
2019/0128163 A1 5/2019 Fritsch et al.

FOREIGN PATENT DOCUMENTS

DE 197 53 842 A1 6/1999
DE 10 2009 057 095 A1 6/2011
(Continued)

OTHER PUBLICATIONS

FR 2872852 A1 English Machine Translation (Year: 2006).*
(Continued)

*Primary Examiner* — Anthony Ayala Delgado
(74) *Attorney, Agent, or Firm* — Crowell & Morning LLP

(57) ABSTRACT

A method for operating a motor vehicle includes a first step of automatically simulating, a second step of determining an operating strategy, and a third step of operating the motor vehicle. In the first step, a quantity of heat emitted by the heating element to the exhaust gas flow and/or to the catalytic converter is automatically simulated by a predefined energy balance model, which models the heating element as an energy balance at least between the electrical energy supplied to the heating element and the quantity of heat emitted by the heating element via heat radiation and convection. In the second step, an operating strategy for the motor vehicle is determined on the basis of a corresponding simulation result in order to achieve a predefined target
(Continued)

temperature range of the catalytic converter. In the third step the motor vehicle is operated according to the determined operating strategy.

7 Claims, 1 Drawing Sheet

(56) References Cited

FOREIGN PATENT DOCUMENTS

| | | | | |
|---|---|---|---|---|
| DE | 10 2011 018 293 | A1 | 12/2011 | |
| DE | 10 2017 219 408 | A1 | 5/2019 | |
| FR | 2872852 | A1 * | 1/2006 | ..... F01N 3/023 |
| WO | WO 2017/151959 | A1 | 9/2017 | |
| WO | WO 2017/151966 | A1 | 9/2017 | |

OTHER PUBLICATIONS

International Search Report (PCT/ISA/210) issued in PCT Application No. PCT/EP2022/085382 dated Mar. 6, 2023 with English translation ( 9 pages).
German-language Written Opinion (PCT/ISA/237) issued in PCT Application No. PCT/EP2022/085382 dated Mar. 6, 2023 with English translation (10 pages).
German-language Search Report issued in German Application No. 10 2022 100 696.4 dated Jul. 22, 2022 with partial English translation (13 pages).

* cited by examiner

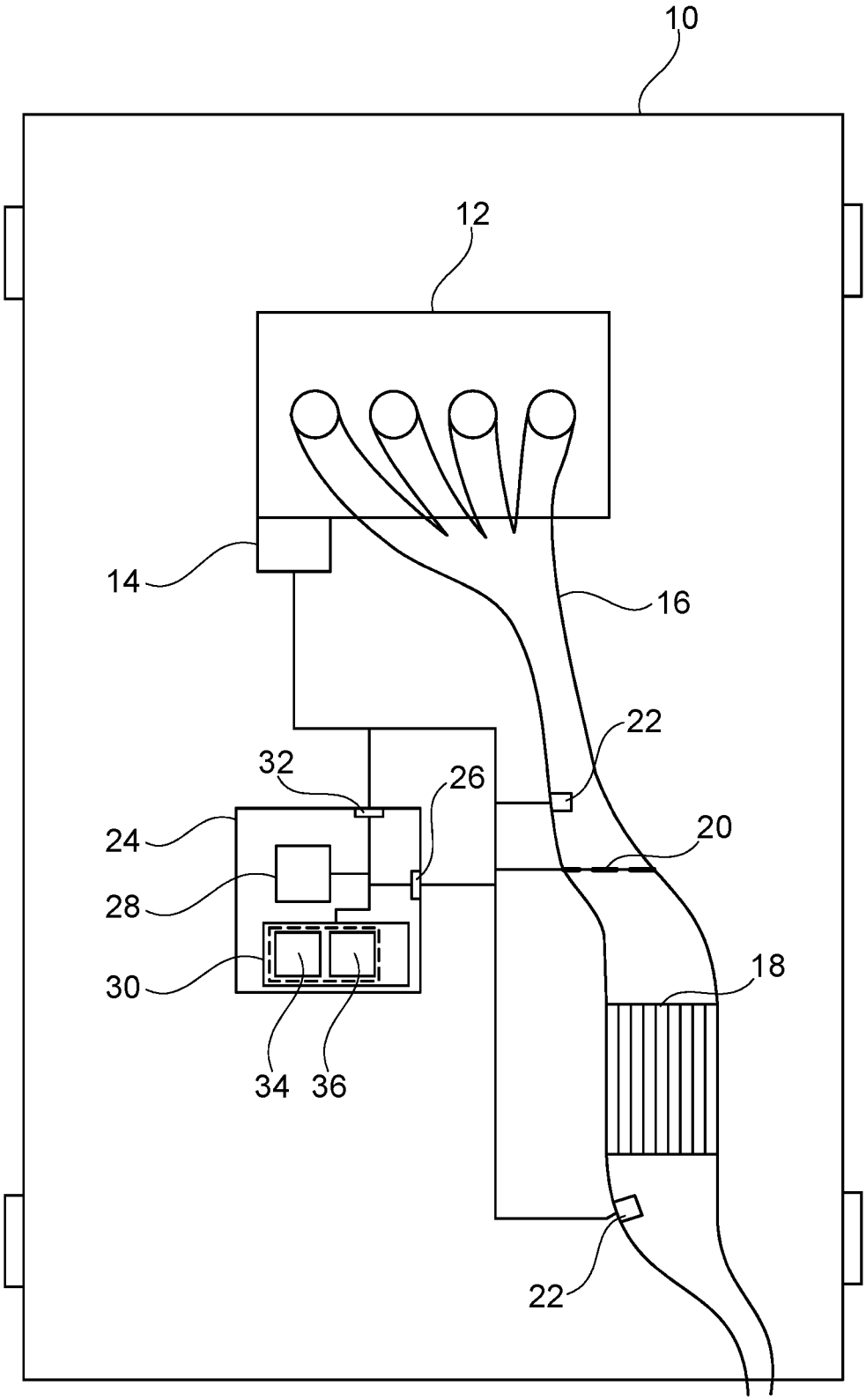
10
12
14
16
22
32
26
24
20
28
18
30
34
36
22

METHOD AND CONTROL DEVICE FOR OPERATING A DIESEL MOTOR VEHICLE FOR EMISSION REDUCTION, AND MOTOR VEHICLE

BACKGROUND AND SUMMARY

The present disclosure relates to a method and a control device for operating a motor vehicle for emission reduction. The disclosure further relates to a correspondingly designed motor vehicle.

There are already various approaches for avoiding or reducing undesired emissions from motor vehicles which are operated by means of an internal combustion engine. Thus, for example, catalytic converters are used widely in exhaust systems of motor vehicles. However, these catalytic converters typically deploy their optimal effect only in a specific temperature range so that after the respective motor vehicle has been started they initially have to be heated up, but on the other hand they also must not overheat. A drawback is that a temperature sensor cannot be arranged in a simple manner in a catalytic converter. Moreover, previous approaches for modelling the thermal behavior in exhaust systems or exhaust lines of motor vehicles cannot always provide optimal accuracy, reliability and robustness. Accordingly there is still potential and need for improvement here.

A method for optimizing nitrogen oxide emissions and carbon dioxide emissions of an internal combustion engine is described as one approach in DE 10 2017 219 408 A1. A simultaneous optimization of these emissions of an internal combustion engine is to be achieved with the method therein by an exhaust gas aftertreatment system of a motor vehicle. To this end, a prediction horizon is selected and a nitrogen oxide limit value is determined. Then a cost function which comprises the nitrogen oxide emissions and the carbon dioxide emissions is minimized, wherein the nitrogen oxide limit value is maintained. Finally actuating members of the internal combustion engine are set to a target value which is determined when minimizing the cost function.

Waste heat, for example from an exhaust gas, occurring during the operation of a motor vehicle can also be used for increasing the efficiency. DE 10 2009 057 095 A1 describes a waste heat-loaded heat utilization device downstream of an internal combustion engine supplying the waste heat or the exhaust gas. The heat utilization device consists of a plurality of components which convey and compress operating means which are present in liquid, vaporous or gaseous form and then expand it in a single closed or partially open operating means flow system.

It is an object of the present disclosure to permit an improved control of a motor vehicle having an internal combustion engine in order to reduce emissions.

This and other objects are achieved according to the disclosure by the subjects of the independent claims. Possible embodiments and developments of the present disclosure are disclosed in the dependent claims, in the description and in the FIGURE.

The method according to the disclosure serves, and can thus be used, for operating a motor vehicle which has a diesel engine and an exhaust gas duct or exhaust system which originates therefrom for guiding an exhaust gas flow from the diesel engine. An electrical heating element and a catalytic converter are arranged in the exhaust gas duct. The catalytic converter can be, in particular, a diesel oxidation catalytic converter (DOC). The heating element, in particular when viewed in the direction of flow of the exhaust gas flow, can be arranged upstream of the catalytic converter, i.e. on the engine side. The heating element can be arranged, for example, in a freestanding manner in the exhaust gas duct or in an exhaust gas flow guided therein during operation or on the engine side on the catalytic converter, i.e. namely attached to the catalytic converter or integrated therein. Thus the method according to the disclosure can be used for reducing emissions or optimizing emissions during the operation of the motor vehicle.

In a method step of the method according to the disclosure during operation of the motor vehicle, for example from an ignition-on signal, a quantity of heat emitted by the heating element to the exhaust gas flow and/or to the catalytic converter, or introduced therein, can be automatically simulated by a predefined energy balance model, i.e. determined for the respective conditions or operating conditions of the motor vehicle, in particular the heating element and/or the diesel engine. The energy balance model models the heating element as an energy balance or by means of an energy balance at least between the electrical energy or power supplied to the heating element and the heat emitted by the heating element via heat radiation and convection. Moreover, heat emitted by the heating element by heat conduction can be modeled or taken into account in the energy balance model or in the energy balance. Thus, for example, a surface temperature of the heating element can be modeled or simulated.

The modelling or simulation can be carried out, in particular, in comparison with a corresponding operation of the motor vehicle without the heating element or without the operation thereof. Thus a difference between the quantity of heat present in the exhaust gas flow and/or in the catalytic converter or introduced therein and/or one or more corresponding temperatures can be simulated by the energy balance model.

The model-based simulation or a plurality of different such simulations can be carried out, for example, in order to determine on the basis thereof an operating variant or an operating scheme of the heating element and/or the diesel engine, whereby it is possible to achieve a predefined target temperature range of the catalytic converter, in particular in the catalytic converter and/or a further catalytic converter which is downstream in the direction of flow. The further catalytic converter can be, for example, an SCR catalytic converter which can be arranged downstream of the DOC catalytic converter. Heat generated for heating the DOC catalytic converter can then be supplied to this further catalytic converter.

Different operating variants or operating schemes of the heating element can be simulated by means of the energy balance model. Thus it is possible to simulate, in particular in real time, a plurality of different electrical powers supplied to the heating element, different operating periods, different switch-on and switch-off times or points in time for the heating element or the electrical supply thereof and/or the like, for example.

For example, it is possible to predefine at least one parameter to be optimized such as a heating-up time of the catalytic converter to be minimized in order to reach the target temperature range, an efficiency to be maximized in order to reach the target temperature range, a total quantity of emissions to be minimized or a specific type of emissions and/or the like.

An input supplied or provided to the energy balance model for carrying out the simulation, i.e. corresponding input data, can also comprise for example temperature data from one or more temperature sensors as corresponding measured temperature values. Such temperature sensors can be arranged, for example, in or on the exhaust gas duct, upstream and/or downstream of the heating element and/or the catalytic converter, but also at different points of the motor vehicle. Thus potentially, for example, actual temperatures of the exhaust gas flow, the exhaust gas duct and/or the like can be known, i.e. be available, as respective input data or input variables for the energy balance model and thus used for the respective simulation or calculation. Thus potentially the simulation or calculation can be carried out particularly accurately and further effects, which are explained in more detail elsewhere, taken into account or simulated.

In a further method step of the method according to the disclosure, an operating strategy for the motor vehicle, in particular for the heating element and/or the diesel engine of the motor vehicle, is determined on the basis of a corresponding simulation result, i.e. an output of the energy balance model and/or potentially on the basis of data derived therefrom by further processing. Such an operating strategy can define, specify or comprise, for example, an operating variant or operating scheme for the heating element, an engine controller or engine operating modes of the diesel engine and/or the like. The operating strategy is determined in order to achieve or to set the predefined target temperature range of the catalytic converter or to maintain this target temperature range after it has been reached. The operating strategy can be carried out, for example, by adapting or selecting one or more parameter values according to the simulation result or the data derived therefrom or also the specification relative to the parameter to be optimized. For example, different operating strategies can be predefined or stored, in each case the most suitable one thereof being able to be selected therefrom. Moreover, for example, permitted value ranges and value combinations or a characteristic field or the like, can be predefined in order to determine the parameter values for the operating strategy. Such specifications can also be stored or modeled as boundary conditions in the energy balance model or a further predefined model which can process, for example, a respective simulation result, i.e. the output of the energy balance model. Thus it can be ensured that the operating strategy is safe and suitable for the respective motor vehicle.

In a further method step of the method according to the disclosure, the motor vehicle, in particular the heating element and/or the diesel engine, is operated according to the determined operating strategy.

The method according to the disclosure can be continuously or regularly repeated during the operation of the motor vehicle or carried out or run in a predefined cycle. Thus the operating strategy for the motor vehicle can be correspondingly continuously or regularly adapted or updated.

For example, in contrast to previous solutions in which the respective total instantaneous electrical power supplied to a heating element is used as a substitute variable or proxy variable for heating up the exhaust gas flow or the catalytic converter, the present disclosure permits a more accurate modelling and simulation of the energy or quantity of heat actually emitted by the heating element to the exhaust gas flow and/or the catalytic converter. Thus, in the present disclosure, an effective value or net value of the heat actually introduced via the heating element into the exhaust gas flow and/or the catalytic converter is determined by taking into account or modelling the energy balance. The present disclosure is based on the knowledge that the electrical energy supplied to the heating element is not necessarily forwarded entirely in the form of heat to the exhaust gas flow and/or the catalytic converter, and this can be modeled, i.e. mapped or recorded, by a corresponding energy balance. Thus the present disclosure ultimately permits a more accurate determination or prediction of the thermal behavior of the exhaust system, in particular the temperature in the catalytic converter or in the catalytic converters, which is important for the emission reduction. Thus in turn a correspondingly optimized control or a correspondingly optimized operation of the motor vehicle is permitted, in order to achieve an emission reduction or emission optimization in a particularly effective and efficient manner. Ultimately a more efficient and/or lower-emission operation of the motor vehicle, potentially with reduced energy use for heating up the catalytic converter and/or reduced thermal wear, can be made possible by the present disclosure.

In one possible embodiment of the present disclosure, at least one first model part or model term which describes or models the heat output via heat radiation and a second model part or model term of the energy balance model which describes or models the heat output via convection are weighted with individual weighting factors in the energy balance model. Moreover, a third model part or model term which describes the heat output via heat conduction and can also be weighted with an individual weighting factor can be described or modeled in the energy balance model. These individual weighting factors are determined or predefined as a function of the respective geometry of the arrangement of the heating element relative to the catalytic converter. The weighting factors can thus be, for example, fixedly predefined and stored in the energy balance model, in particular specifically for or adapted to the respective motor vehicle, a model variant of the motor vehicle or a model variant of the exhaust system of the motor vehicle, or the like. If the exhaust system has or permits a changeable geometry or a variable exhaust gas duct or the like, for example different adjustable flow paths or the like, the weighting factors can correspondingly be automatically adapted or set dynamically.

For predetermining or setting the weighting factors, it can be determined, for example once, namely during production of the motor vehicle, whether or to what extent in the respective application, i.e. for example in the respective motor vehicle or the respective exhaust system, the heat output from the heating element to the catalytic converter is dominated by the heat radiation term or the convection term or the heat conduction term. The heat radiation term can dominate, for example, when the heating element is arranged on the engine side or inflow side, directly upstream of the catalytic converter, so that over the entire surface of the heating element a direct visible connection is provided to the catalytic converter. However, the convection term can dominate, for example, when a bend or curvature of the exhaust gas duct is arranged between the heating element and the catalytic converter. Heat radiated from the heating element would then potentially come into contact with an inner wall of the exhaust gas duct and not directly with the catalytic converter, and then depending on the respective geometry potentially contribute via heat conduction to the heating of the catalytic converter. The thermal behavior can also be influenced by flow properties of the exhaust gas duct or by flow conditions in the exhaust system. This can also be correspondingly taken into account for determining the weighting factors. The prevailing flow conditions can be dynamic or variable. For example, different flow conditions can prevail in different operating modes or operating states. Then different weighting factors or a dynamic adaptation of the weighting factors can be correspondingly used.

Corresponding individual properties can be modeled particularly easily and flexibly by the individual weighting factors provided here and the energy balance model can thus be adapted in a particularly simple manner to different applications.

In a further possible embodiment of the present disclosure, a time curve of the quantity of heat emitted by the heating element to the exhaust gas flow and/or to the catalytic converter is simulated over a predefined time period by means of the energy balance model. In other words, developments or changes to the heat output and/or one or more corresponding temperatures can be simulated over a predefined operating time or operating period of the motor vehicle. This can be carried out, in particular, in any simulation process. In this manner, knowledge about dynamic developments, and not only about a static state, can be obtained or effects or impacts of dynamic developments can be identified or taken into account. Thus ultimately an even more improved, more efficient or more accurate control of the motor vehicle can be made possible regarding an emission reduction which is as efficient and effective as possible.

In a further possible embodiment of the present disclosure, power or energy or a quantity of heat potentially emitted by the exhaust gas to the heating element is also modeled in the energy balance model as part of the energy balance and simulated by means of the energy balance model. As a result it can be taken into account that, for example before or at the beginning of starting up the heating element, due to its heat capacity it can draw heat from the exhaust gas flow, i.e. it can absorb heat from the exhaust gas flow. This heat then does not contribute, or not directly, to heating up the catalytic converter. The quantity of heat input into the catalytic converter or a time curve of this heat input can be more accurately modeled or simulated by taking into account this effect which can be dependent on the heat capacity of the heating element and a difference between a surface temperature of the heating element and a temperature of the exhaust gas flow. Thus ultimately a more accurate determination or prediction of the temperature actually provided in the catalytic converter and a correspondingly more accurate, more effective or more efficient control of the motor vehicle regarding an overall efficiency and/or emission reduction can be made possible.

In a further possible embodiment of the present disclosure, a portion of the electrical energy supplied to the heating element which causes a temperature change of the heating element is also modeled in the energy balance model as part of the energy balance, and is simulated by means of the energy balance model. This proportion can be modeled or simulated, for example, on the basis of a thermal mass and/or specific heat capacity of the heating element-potentially stored in the energy balance model as a parameter value. Thus it can be taken into account that this proportion of the supplied energy or a corresponding quantity of heat initially is not directly forwarded via the heating element to the exhaust gas flow. For example, it can lead to a decelerated or time-delayed output of the corresponding energy or quantity of heat by the heating element. Moreover, at least one portion of this energy or quantity of heat can remain stored in the heating element after the motor vehicle has been switched off. The corresponding energy or heat stored in the heating element thus does not contribute to heating up the exhaust gas flow or the catalytic converter during operation of the motor vehicle. Ultimately the quantity of heat actually introduced into the catalytic converter or a time curve of this introduced quantity of heat can be more accurately determined or estimated by the embodiment of the present disclosure proposed herein. This can permit a more accurate estimation of the temperature of the catalytic converter and ultimately a correspondingly improved control of the motor vehicle, for example regarding an efficiency and/or an effectiveness of the emission reduction.

In a further possible embodiment of the present disclosure, a heat output from the heating element via heat conduction is also modeled in the energy balance model as part of the energy balance, and is then correspondingly simulated by means of the energy balance model. Since the heating element has to be held or fastened in some form, this results in a corresponding heat conduction path via which heat can flow away, i.e. can be dissipated, from the heating element. Thus, for example, heat can be dissipated from the heating element to the catalytic converter and/or from the exhaust system of the motor vehicle, namely to a frame, a body or ultimately an environment of the motor vehicle. Such a heat conduction or heat dissipation can take place in each case by at least one corresponding material connection, i.e. a corresponding heat conduction path. This can be taken into account, i.e. modeled, in the present case in the energy balance model. If required, the quantity of heat actually introduced into the catalytic converter and thus the temperature thereof can be even more accurately determined or estimated by taking into account the proportion of energy or heat potentially flowing away from the heating element or flowing toward the heating element by heat conduction. Thus ultimately a correspondingly more accurate and optimized control of the motor vehicle is also made possible, namely regarding the efficiency and/or effectiveness of the emission reduction. In order to take into account the heat conduction of this type, for example, corresponding material or component parameters of components of the motor vehicle directly or indirectly in mechanical contact with the heating element can be stored as parameter values in the energy balance model.

In a further possible embodiment of the present disclosure, a heat output from the heating element after the electrical supply, i.e. the electrical power supply, to the heating element has been switched off is also modeled in the energy balance model as part of the energy balance, and is then correspondingly simulated by means of the energy balance model. Thus it can be taken into account that the heating element can continue to emit heat after the electrical power supply has been switched off. This post-heating effect or after-heating effect can influence the temperature or the temperature curve of the catalytic converter. In previous models which use, for example, only the instantaneous electrical power supplied to the heating element as a substitute variable or proxy variable for heating the exhaust gas flow or the catalytic converter, no further heating or, in contrast to reality, an accelerated cooling of the catalytic converter, would be assumed after the electrical power supply to the heating element has been switched off. This drawback is circumvented or solved by the embodiment of the present disclosure proposed herein. Thus the quantity of heat actually introduced into the catalytic converter or the temperature thereof can be even more accurately determined or estimated. This ultimately permits a further improved or more accurate control of the motor vehicle, namely regarding the efficiency and/or effectiveness of the emission reduction.

In a further possible embodiment of the present disclosure, the temperature inside the catalytic converter is simulated by means of the energy balance model or on the basis of the simulation result. In the last case, the temperature in the catalytic converter can be modeled and simulated, for example, by means of a corresponding predefined temperature model for the catalytic converter. The simulation result, i.e. the output of the energy balance model, can be supplied or provided to this temperature model as input, i.e. as input data. It is also provided here that the operating strategy for the motor vehicle is determined on the basis of the simulated temperature for the interior of the catalytic converter. The temperature inside the catalytic converter can be of particular importance for the emission reduction but, as explained elsewhere, cannot feasibly be directly measured in a simple manner. Due to the dedicated simulation of the temperature inside the catalytic converter this can be particularly accurately determined and, on the basis thereof, ultimately the emission reduction carried out particularly accurately, particularly efficiently and/or particularly effectively by a correspondingly adapted or regulated control of the motor vehicle. For modelling or simulating the temperature inside the catalytic converter, for example, its thermal mass, heat capacity, radiation behavior, flow resistance and/or the like, can be modeled or predefined as model parameters.

A further aspect of the present disclosure is a control device for a motor vehicle. The control device according to the disclosure has an input interface for detecting input data, a processor device, i.e. for example a microchip, microprocessor or microcontroller or the like, a computer-readable data memory connected thereto and an output interface for the output of control signals. The input data detected via the input interface can be processed and corresponding control signals generated by means of the processor device and the data memory. The control signals can then be output via the output interface. The input interface and the output interface can be individual or separate interfaces or integrated or combined in a bidirectional data interface. The control device according to the disclosure can also comprise further and/or distributed hardware components. The control device according to the disclosure is designed to carry out automatically the method according to the disclosure, in particular during an operation of the respective motor vehicle respectively provided with the control device. To this end, for example, a corresponding operating or computer program which implements or codes the method steps, measures or sequences of the method according to the disclosure or corresponding control instructions can be stored in the data memory.

This operating or computer program can be performed by means of the processor device in order to execute the responsive program or to bring about the execution thereof. The input data can be or comprise, for example, the electrical power supplied to the heating element, one or more measured temperatures, one or more operating parameters or operating states of the motor vehicle, in particular of the engine of the motor vehicle, and/or the like. The control signals generated as output by the control device can be designed, i.e. serve, for example, directly or indirectly for controlling or activating the heating element, the engine of the motor vehicle, a possibly present engine control device of the motor vehicle and/or the like. The control device according to the disclosure can thus be designed, i.e. used or deployed, to carry out the method steps, measures or sequences described in connection with the method according to the disclosure.

The control device according to the disclosure can be designed, for example, as a dedicated emission control device. Moreover, the control device according to the disclosure can be designed for carrying out one or more further tasks or functions. For example, the control device according to the disclosure can be the engine control device or combined therewith or integrated therein.

A further aspect of the present disclosure is a motor vehicle which has a diesel engine, an exhaust gas duct or exhaust system which originates therefrom and in which a catalytic converter, in particular a DOC, and an electric heating element, on the engine side thereof, are arranged, and a control device according to the disclosure. The motor vehicle according to the disclosure can also be designed to carry out automatically the method according to the disclosure. The motor vehicle according to the disclosure can be, in particular, the motor vehicle mentioned in connection with the method according to the disclosure and/or in connection with the control device according to the disclosure or correspond thereto.

Further features of the disclosure can be found in the claims, the figures and the description of the figures. The features and combinations of features mentioned above in the description and the features and combinations of features shown hereinafter in the description of the figures and/or alone in the figures, can be used not only in the respectively specified combination but also in other combinations or individually without departing from the scope of the disclosure.

The drawing shows in the only FIGURE a schematic overview of a motor vehicle which is designed for low-emission operation, in which:

BRIEF DESCRIPTION OF THE DRAWING

FIG. 1 shows a fragmentary schematic view of a motor vehicle according to the present disclosure.

DETAILED DESCRIPTION OF THE DRAWING

FIG. 1 shows a fragmentary schematic view of a motor vehicle 10 with an internal combustion engine which in the present case is designed as a diesel engine 12. The diesel engine 12 or an operation or a mode of operation of the diesel engine 12 can be controlled by means of an engine control device 14. An exhaust system 16 is connected to the diesel engine 12 for discharging an exhaust gas flow and for the exhaust gas aftertreatment. The exhaust system 16 also has a catalytic converter 18, in particular a DOC, which is arranged in the exhaust gas duct and an electrical heating element 20 upstream thereof, i.e. arranged on the engine side of the catalytic converter 18 in the exhaust gas duct. Furthermore, several indicated temperature sensors 22 are provided here. For example, one of these temperature sensors 22 is arranged in the exhaust gas duct upstream of the heating element 20 and another of the temperature sensors 22 is arranged behind, i.e. downstream of the catalytic converter 18, i.e. on a side of the catalytic converter 18 in the exhaust gas duct facing away from the diesel engine 12. Further temperature sensors 22 can also be provided and/or the temperature sensors 22 can be arranged at different points.

In the present case the motor vehicle 10 has a correspondingly designed emission control device 24 for controlling or optimizing the exhaust gas aftertreatment for emission reduction by means of the catalytic converter 18. This comprises an input interface 26, a processor 28, a computer-readable data memory 30 connected thereto and an output interface 32. The emission control device 24 can receive via the input interface 26, for example, current operating, status, or measurement data from the heating element 20, the temperature sensors 22 and the diesel engine 12 or the motor control device 14. Correspondingly received data or signals, i.e. detected via the input interface 26, can be processed by means of the processor 28 and the data memory 30. In the present case, a predefined energy balance model 34 and a temperature model 36 are stored in the data memory 30. Results from the processing of data or corresponding control signals can be output via the output interface 32, for example to the heating element 20 and/or the diesel engine 12 or the engine control device 14. The emission control device 24 and the engine control device 14 can be combined together. For example, the emission control device 24 and the engine control device 14 can represent parts of a combined control device, not shown here, or different hardware and/or software modules or hardware and/or software components of such a combined control device. The input interface 26 and/or the output interface 32 can be or comprise, for example, program or software interfaces or data transfer functions or the like.

If the electrical heating element 20 is activated, the entire electrical power supplied thereto is not output to the exhaust gas flow which is guided in the exhaust system 16 or the catalytic converter 18. For example, a part of the supplied electrical power is required for heating the heating element 20 itself and potentially a further part of the supplied power can be removed via heat radiation and/or heat conduction from the exhaust system 16 and thus, in particular, contribute not at all, only to a limited extent or indirectly, to heating the catalytic converter 18. After switching off the heating element 20 or the electrical power supply of the heating element 20, this heating element can also emit heat to the exhaust gas flow due to its thermal mass.

The energy balance model 34 models the electrical heating element 20 or the thermal effect thereof on the exhaust gas flow and/or the catalytic converter 18 as the energy balance of the electrical energy supplied to the heating element 20, the energy emitted via convection to the exhaust gas flow or the energy transmitted from the exhaust gas flow to the heating element 20, the energy emitted or received by the heating element 20 via heat radiation, the energy required for changing the temperature of the heating element 20 and the energy received or diverted via heat conduction from the heating element 20. For different applications or requirements for simplifying the modeling or the corresponding implementation, for example, some subordinate terms thereof and/or further terms or inputs may not be implemented or can be switched off or deactivated, i.e. remain unconsidered. This can be dependent, for example, on a respectively available memory capacity and/or computing capacity of the emission control device 24 and/or on the number and arrangement of the temperature sensors 22, i.e. the availability of corresponding measurement and/or temperature data.

The energy balance model 34 is executed or used during the operation of the motor vehicle 10 in order to simulate the effective heating power of the heating element 20, i.e. the effect or impact thereof on a thermal behavior or a thermal state of the exhaust system 16, in particular of the catalytic converter 18. For example, a surface temperature of the heating element 20, the quantity of heat introduced therefrom into the exhaust gas flow and/or the catalytic converter and/or the like, can be simulated, i.e. calculated or estimated, as a simulation result or output of the energy balance model 34.

An operating strategy for the motor vehicle 10 for emission reduction can be determined on the basis of the simulation result, for example also by the emission control device 24. Based on the simulation result, for example by means of the predefined temperature model 36, the temperature respectively currently prevailing or predicted during or after deploying a specific operating strategy in the catalytic converter 18 can be simulated, i.e. determined or estimated. The energy balance model 34 and the temperature model 36 can also be combined together, i.e. brought together in a single model, which is indicated here by a dashed line.

The operating strategy, which is determined in this manner on the basis of corresponding model values or simulation results of the energy balance model 34 and or also the temperature model 36, can be used, for example, for controlling the electrical power supply to the heating element 20 and/or the operating mode or the operating type of the diesel engine 12, for example by the emission control device 24, the engine control device 14 and/or one or more devices of the motor vehicle 10, not shown here in detail.

The energy balance model 34 or the temperature model 36 can be generated, for example, by means of a conventional software system for creating technical-physical models. It has been shown that the temperatures actually measured in the exhaust gas line can be effectively mapped or simulated by a corresponding model.

Overall the described examples show how a modelling of a heat exchange of an electrical heating device in internal combustion engines, in particular diesel engines, can be implemented in order to achieve ultimately an improved vehicle control for emission reduction and/or an increase in efficiency.

LIST OF REFERENCE SIGNS

10 Motor vehicle
12 Diesel engine
14 Engine control device
16 Exhaust system
18 Catalytic converter
20 Heating element
22 Temperature sensor
24 Emission control device
26 Input interface
28 Processor
30 Data memory
32 Output interface
34 Energy balance model
36 Temperature model

The invention claimed is:

1. A method for operating a motor vehicle comprising:

automatically simulating, during operation of the motor vehicle, wherein the motor vehicle which has a diesel engine, an exhaust gas duct which originates therefrom for guiding an exhaust gas flow from the diesel engine with an electrical heating element arranged therein and a catalytic converter, a quantity of heat emitted by the heating element to the exhaust gas flow and/or to the catalytic converter by a predefined energy balance model which models the heating element as an energy balance at least between the electrical energy supplied to the heating element and the quantity of heat emitted by the heating element via heat radiation and convection;

determining an operating strategy for the motor vehicle is determined on the basis of a corresponding simulation result in order to achieve a predefined target temperature range of the catalytic converter; and operating the motor vehicle according to the determined operating strategy, wherein a first model term which models the heat output via heat radiation and a second model term which models the heat output via convection are weighted with individual weighting factors in the energy balance model, the weighting factors being determined as a function of the respective arrangement of the heating element relative to the catalytic converter, a heat output from the heating element via heat conduction is also simulated in the energy balance model as part of the energy balance, and a heat output from the beat ag element after the electrical power supply to the heating element has been switched off is also simulated in the energy balance model as part of the energy balance.

2. The method according to claim 1, wherein a time curve of the quantity of heat emitted by the heating element to the exhaust gas flow and/or to the catalytic converter is simulated over a predefined time period by means of the energy balance model.

3. The method according to claim 1, wherein a quantity of heat potentially emitted by the exhaust gas to the heating element is also simulated in the energy balance model as part of the energy balance.

4. The method according to claim 1, wherein a portion of the electrical energy supplied to the heating element which causes a temperature change of the heating element is also simulated in the energy balance model as part of the energy balance.

5. The method according to claim 1, wherein the temperature inside the catalytic converter is simulated via the energy balance model and/or on the basis of the simulation result, and the operating strategy for the motor vehicle is determined on the basis of this simulated temperature.

6. A control device for a motor vehicle comprising:

an input interface configured to detect input data;

a processor device;

a data memory connected to the processor; and an output interface configured to output of control signals, wherein the control device configured to carry out the method according to claim 1.

7. A motor vehicle comprising:

the control device according to claim 6.

* * * * *